US008074626B2

(12) United States Patent
Fukushima

(10) Patent No.: US 8,074,626 B2
(45) Date of Patent: Dec. 13, 2011

(54) CHARGE CONTROL UNIT AND CHARGE CONTROL SYSTEM FOR FUEL INJECTION VALVE

(75) Inventor: Takayuki Fukushima, Okazaki (JP)

(73) Assignee: Denso Corporation, Kariya (JP)

( * ) Notice: Subject to any disclaimer, the term of this patent is extended or adjusted under 35 U.S.C. 154(b) by 3 days.

(21) Appl. No.: 12/926,421

(22) Filed: Nov. 17, 2010

(65) Prior Publication Data

US 2011/0061632 A1 Mar. 17, 2011

Related U.S. Application Data

(62) Division of application No. 12/177,218, filed on Jul. 22, 2008.

(30) Foreign Application Priority Data

Aug. 9, 2007 (JP) ..... 2007-207373

(51) Int. Cl.
*F02M 51/00* (2006.01)
*B05B 1/08* (2006.01)
*B05B 3/04* (2006.01)

(52) U.S. Cl. ..... 123/494; 239/102.2

(58) Field of Classification Search ..... 123/480, 123/494, 467, 498; 239/88, 89, 90, 91, 92, 239/93, 94, 95, 96, 102.2; 310/311, 316.03, 310/317, 323.06
See application file for complete search history.

(56) References Cited

U.S. PATENT DOCUMENTS 6,062,489 A * 5/2000 Tokumaru ..... 239/124
6,619,268 B2 * 9/2003 Rueger et al. ..... 123/490
6,907,864 B2 * 6/2005 Takemoto ..... 123/478
7,034,437 B2 * 4/2006 Fukagawa et al. ..... 310/316.03
7,626,315 B2 * 12/2009 Nagase ..... 310/316.03
2005/0022793 A1 2/2005 Takemoto et al.
2006/0279592 A1 * 12/2006 Nagase ..... 347/10
2007/0028895 A1 * 2/2007 Fujii ..... 123/446
2008/0017173 A1 * 1/2008 Fujii ..... 123/478

FOREIGN PATENT DOCUMENTS

JP 63-088247 4/1988
JP 2002-115616 4/2002
JP 2006-144588 6/2006
JP 2006-348912 12/2006

OTHER PUBLICATIONS

Japanese Office Action dated Jun. 26, 2009, issued in corresponding Japanese Application No. 2007-207373 with an at least partial English-language translation.

* cited by examiner

*Primary Examiner* — Stephen K Cronin
*Assistant Examiner* — Sizo Vilakazi
(74) *Attorney, Agent, or Firm* — Nixon & Vanderhye P.C.

(57) ABSTRACT

A charge control unit controls electricity charged to a piezo element, which is for actuating a backpressure control valve so as to control backpressure applied to a valve element for a fuel injection valve. The backpressure control valve is configured to start to decrease the backpressure to actuate the valve element to open an injection port of the fuel injection valve when voltage of the electricity exceeds a threshold. A charge unit increases the voltage by repeating increasing and decreasing a drive current, which is supplied to the piezo element, for multiple times for charging the piezo element. A switching unit alternates the increasing and the decreasing such that the voltage exceeds the threshold in an intermediate period in a middle of a specific increasing period among multiple increasing periods, in each of which the drive current increases.

15 Claims, 7 Drawing Sheets

CHARGE SWITCH ON

CHARGE SWITCH OFF

DISCHARGE SWITCH ON

DISCHARGE SWITCH OFF

CHARGE CONTROL UNIT AND CHARGE CONTROL SYSTEM FOR FUEL INJECTION VALVE

CROSS REFERENCE TO RELATED APPLICATIONS

This application is a divisional of U.S. application Ser. No. 12/177,218 filed Jul. 22, 2008, which claims priority to Japanese Patent Application No. 2007-207373 filed on Aug. 9, 2007, the entire content of each of which is incorporated herein by reference.

FIELD OF THE INVENTION

The present invention relates to a charge control unit for a fuel injection valve having a piezo element as an actuator. The invention further relates to a charge control system having the charge control unit.

BACKGROUND OF THE INVENTION

According to JP-A-2006-144588, a fuel injection valve includes a valve element for opening and closing a fuel injection port, a backpressure control valve for controlling backpressure of the valve element, and piezo elements for actuating the backpressure control valve. When the piezo elements are charged so as to expand, the piezo elements actuate the backpressure control valve to reduce backpressure of the valve element, and thereby the valve element performs an opening operation, and fuel is injected from the injection port.

In JP-A-2006-144588, after charge of the piezo elements is started, the backpressure control valve starts operation at the time point when a voltage value of charged power exceeds a threshold value Vth (refer to FIG. 5B). Conventionally, a charge control unit for controlling electric charge of the piezo elements is typically designed such that while a drive current to be supplied to the piezo elements is repeatedly increased and decreased for several times (refer to FIG. 5A), a voltage value is increased (refer to FIG. 5B) so that the piezo elements are charged.

Here, for example, even when the amount of electric charge of the piezo elements is fixed, the piezo elements may differently expand depending on temperature in each charge operation. Moreover, because of aged deterioration such as ablation of a valve seat for the valve element or the backpressure control valve, even when the amount of electric charge of the piezo elements is fixed, the piezo elements may differently expand depending on ablation in each charge operation. That is, variation may occur in timing, at which the backpressure control valve starts operation, due to the aged deterioration or a temperature characteristic of each piezo element. Thus, variation may occur in valve opening operation timing (injection start timing) of the valve element.

SUMMARY OF THE INVENTION

In view of the foregoing and other problems, it is an object of the present invention to produce a charge control unit, which is configured to reduce variation in start timing of fuel injection in a fuel injection valve having a piezo element as an actuator. It is another object of the present invention to produce a fuel-injection-valve charge control system having the charge control unit.

According to one aspect of the present invention, a charge control unit for controlling electricity charged to a piezo element, which is for actuating a backpressure control valve so as to control backpressure applied to a valve element for a fuel injection valve, wherein the backpressure control valve is configured to start to decrease the backpressure to actuate the valve element to open an injection port of the fuel injection valve when voltage of the electricity exceeds a threshold, the charge control unit comprises a charge unit configured to increase the voltage by repeating increasing and decreasing a drive current, which is supplied to the piezo element, for a plurality of times for charging the piezo element. The charge control unit comprises a switching unit configured to alternate the increasing and the decreasing in the drive current such that the voltage exceeds the threshold in an intermediate period in a middle of a specific increasing period among a plurality of increasing periods, in each of which the drive current increases.

According to another aspect of the present invention, a charge control unit for controlling electricity charged to a piezo element, which is for actuating a valve element for a fuel injection valve, wherein the valve element is configured to start to open an injection port of the fuel injection valve when voltage of the electricity exceeds a threshold, the charge control unit comprises a charge unit configured to increase the voltage by repeating increasing and decreasing a drive current, which is supplied to the piezo element, for a plurality of times for charging the piezo element. The charge control unit further comprises a switching unit configured to alternate the increasing and the decreasing in the drive current such that the voltage exceeds the threshold in an intermediate period in a middle of a specific increasing period among a plurality of increasing periods, in each of which the drive current increases.

BRIEF DESCRIPTION OF THE DRAWINGS

The above and other objects, features and advantages of the present invention will become more apparent from the following detailed description made with reference to the accompanying drawings. In the drawings:

FIGS. 6A to 6D are diagrams showing change in each of drive current and fuel injection ratio according to a second embodiment, wherein FIGS. 6A, 6B show the change during high load operation of an engine, and FIGS. 6C, 6D show the change during low load operation of the engine.

DETAILED DESCRIPTION OF PREFERRED EMBODIMENTS

First Embodiment

Figure 1:
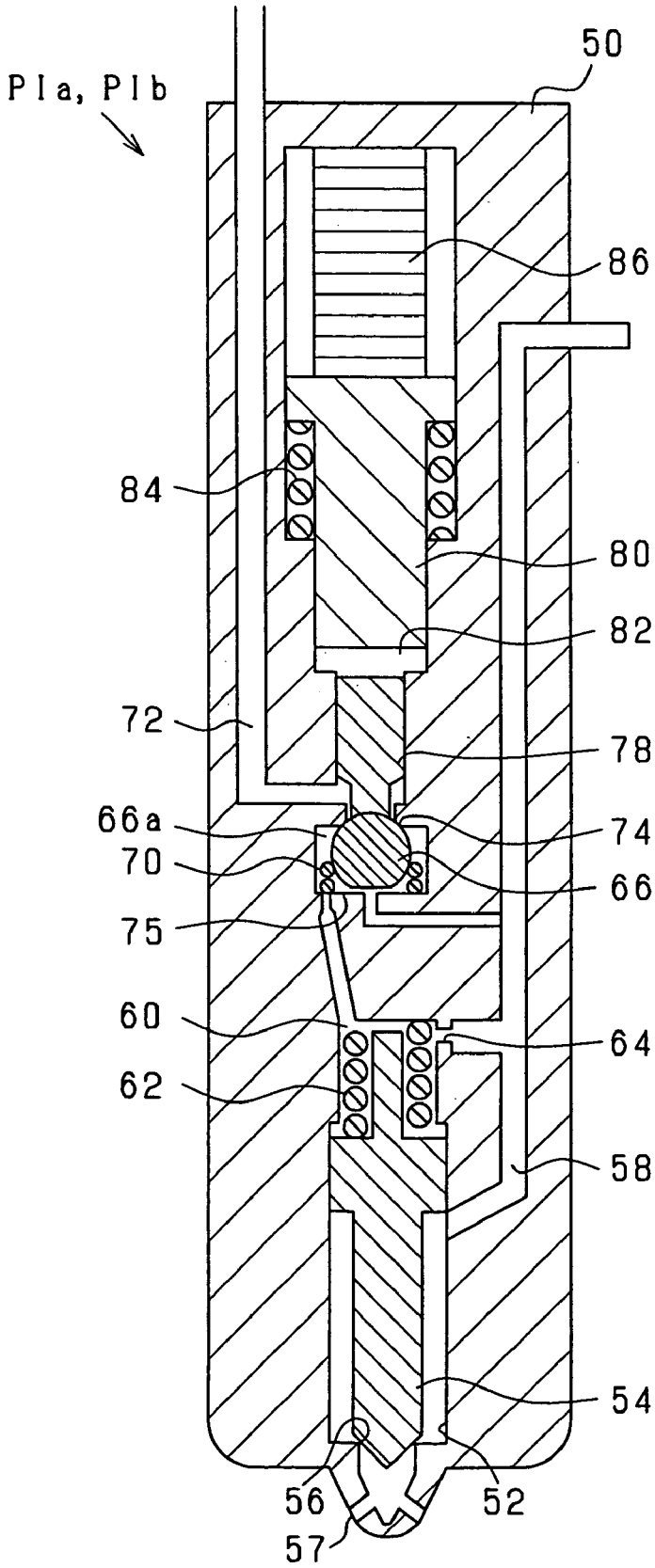
FIG. 1 is a sectional view showing a piezo injector according to an embodiment.

First, a structure of a piezo injector for a fuel injection valve according to the present first embodiment is described with reference to FIG. 1. In the present embodiment, piezo injectors PIa and PIb are used for a fuel injection valve in a common-rail fuel injection system of a diesel engine, which is an example of an internal combustion engine.

In each of the piezo injectors PIa and PIb, a cylindrical needle recess 52 is provided in a tip portion of a body 50. The needle recess 52 accommodates a nozzle needle 54 as a valve element that can be displaced in an axial direction of the nozzle needle 54. When the nozzle needle 54 is seated on an annular needle seat 56, which is provided in a tip portion of the body 50 to perform a closing operation, the nozzle needle 54 blockades the needle recess 52 from the outside, which communicates with a combustion chamber of the internal combustion engine, so that an injection port 57 is closed. On the other hand, when the nozzle needle 54 is lifted from the annular needle seat 56 to perform an opening operation, the nozzle needle 54 communicates the needle recess 52 with the outside, so that the injection port 57 is opened. Moreover, when the nozzle needle 54 is lifted from the seat 56, the needle recess 52 is supplied with high pressure fuel from a common rail (not shown) through a high-pressure fuel path 58.

The backside of the nozzle needle 54 on the opposite side to the needle seat 56 is opposed to a backpressure chamber 60. The backpressure chamber 60 is supplied with fuel from the high-pressure fuel path 58 through an orifice 64. The backpressure chamber 60 accommodates a needle spring 62 that biases the nozzle needle 54 toward a needle seat 56.

The backpressure chamber 60 is configured to communicate with a low-pressure fuel path 72 through a balanced three-way valve 66 as a backpressure control valve. The balanced three-way valve 66 is biased to a rear side of the body 50 toward the upside in FIG. 1 by a valve spring 70. The three-way valve 66 is seated at the backside thereof on an annular low-pressure valve seat 74 by being exerted with force from the valve spring 70, and is lifted from a high-pressure valve seat 75. In the present condition, the three-way valve 66 blockades the low-pressure fuel path 72 from the backpressure chamber 60, and communicates the high-pressure fuel path 58 with the backpressure chamber 60 through an accommodation chamber 66*a*, which accommodates the balanced three-way valve 66.

On the other hand, when the three-way valve 66 is displaced to a front side of the body 50 toward the lower side in FIG. 1 against the force exerted from the valve spring 70, the three-way valve 66 is lifted from the low-pressure valve seat 74, and is seated on the high-pressure valve seat 75. In the present condition, the low-pressure fuel path 72 communicates with the backpressure chamber 60, and the three-way valve 66 blockades the high-pressure fuel path 58 from the accommodation chamber 66*a* of the backpressure chamber 60.

The three-way valve 66 is opposed to an end of a valve piston 78 at a surface on the side of the low-pressure valve seat 74. On the other hand, the valve piston 78 is opposed to an end of a piezo piston 80 at a rear side thereof. The valve piston 78, the piezo piston 80, and the inner circumferential surface of the body 50 thereamong define a displacement enlarging room 82. In the displacement enlarging room 82, two cylindrical spaces are connected in series via a diameter-reduction portion such that the surface area is large at the rear side of the body 50 compared with the surface area at the front side of the body 50. The displacement enlarging room 82 is filled with liquid such as fuel.

The piezo piston 80 is biased to the backside of the body 50 by a piezo spring 84. Furthermore, the piezo piston 80 is connected to a piezo stack 86 as a stacked body, which is formed by stacking a number of piezo elements Pa and Pb (refer to FIG. 2) at the rear side of the body 50. Each of the piezo elements Pa and Pb is a capacitive load, which is configured to expand and contract by a piezoelectric effect. The state of each of the piezo elements Pa and Pb is changed between an expanding state and a contracting state by being charged or discharged. Thus, the piezo stack 86 acts as an actuator for actuating the three-way valve 66.

The piezo stack 86 is fixed to the body 50 at the backside on the opposite side of the piezo piston 80. Therefore, when the piezo elements Pa and Pb are not supplied with a drive current and therefore the piezo elements Pa and Pb are respectively in the contracting state, the piezo piston 80 is displaced toward the rear side of the body 50 by being biased from the piezo spring 84. In this condition, since the valve piston 78 does not actuate the three-way valve 66 toward the front side of the body 50, the backpressure chamber 60 is blockaded from the low-pressure fuel path 72 by the three-way valve 66. Consequently, the nozzle needle 54 is biased toward the front side of the body 50 by being applied with fuel pressure, which is equivalent to the common rail pressure in the backpressure chamber 60, and the biasing force of the needle spring 62. Thus, the nozzle needle 54 is seated on the needle seat 56 to be in the valve closing state.

On the other hand, when the piezo elements Pa and Pb are supplied with the drive current and thereby the elements Pa and Pb are respectively in the expanding state, the piezo piston 80 is displaced toward the front side of the body 50 against the biasing force of the piezo spring 84. Thus, the valve piston 78 displaces the three-way valve 66 toward the front side of the body 50 thereby to open the low-pressure valve seat 74, so that the backpressure chamber 60 communicates with the low-pressure fuel path 72. As a result, pressure of fuel in the backpressure chamber 60 is reduced, so that force of the high pressure fuel in the needle recess 52 biasing the nozzle needle 54 toward the rear side of the body 50 increases. When the force of the high pressure fuel in the needle recess 52 increases to a certain level or more compared with total of the force of the fuel in the backpressure chamber 60 and the biasing force of the needle spring 62 exerted to the nozzle needle 54 toward the front side of the body 50, the nozzle needle 54 is lifted from the needle seat 56 to be in the valve opening state.

Figure 2:
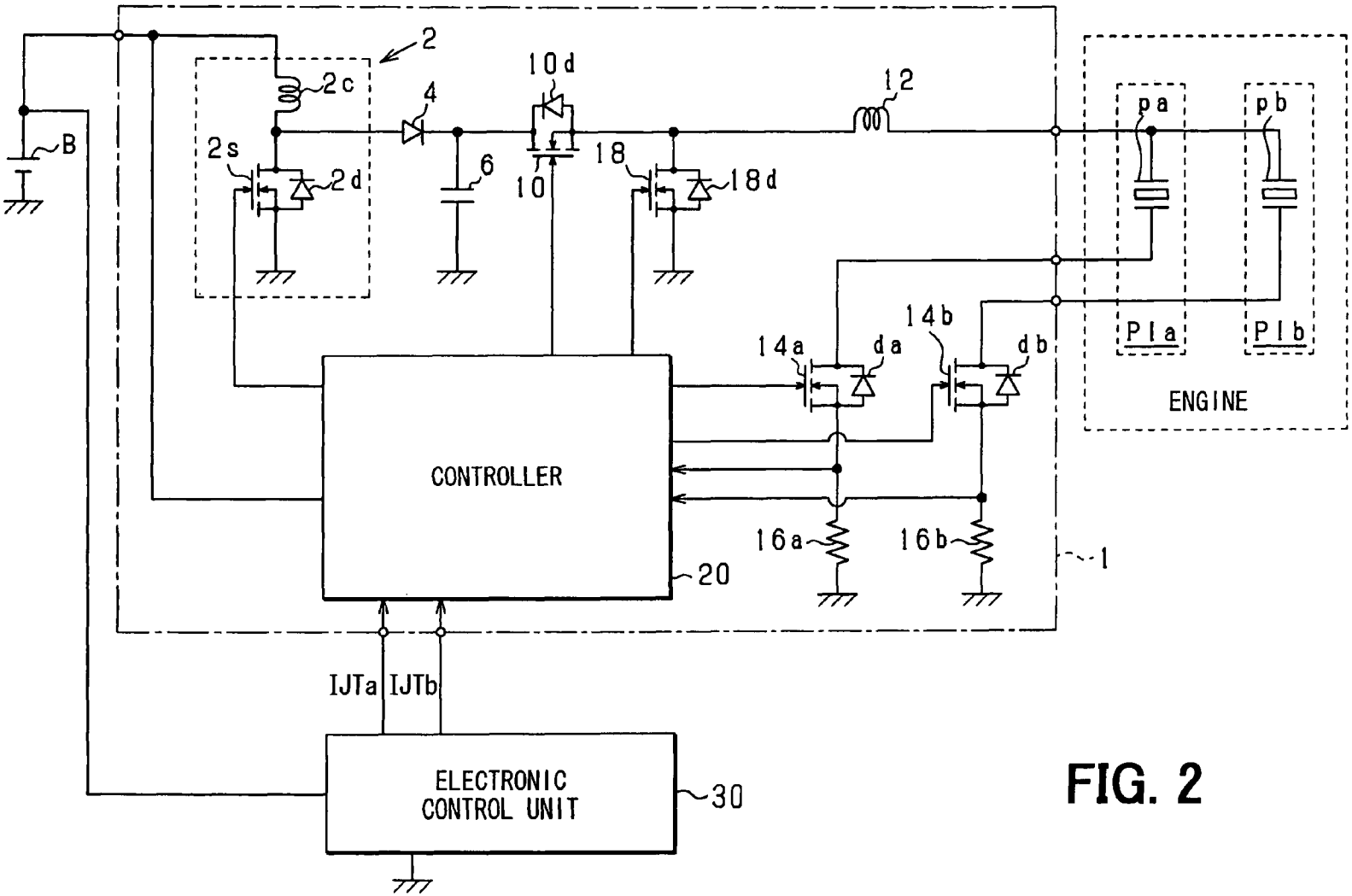
FIG. 2 is a block diagram showing a drive unit (charge control unit) according to a first embodiment.

FIG. 2 shows a general configuration of a drive unit as a charge control unit that controls charge and discharge of the piezo elements Pa and Pb to control a drive operation of the piezo elements Pa and Pb. As shown in FIG. 2, the drive unit of the piezo injectors PIa and PIb according to the present embodiment performs a charge control and a discharge control of the piezo elements Pa and Pb in order to drive the piezo injectors PIa and PIb. The drive unit of the piezo injectors PIa and PIb includes an electronic control unit 30 and a driver unit 1 as a charge unit. The electronic control unit 30 includes a central processing unit and the like to control the diesel engine. The driver unit 1 and the electronic control unit 30 is supplied with power from a battery B.

Next, the driver unit 1 is described. Electric power is first supplied from the battery B into a DC-DC converter 2 being a step-up circuit. The DC-DC converter 2 is configured by a series-connected body of a coil 2*c* and a charge switch 2*s*. The charge switch 2*s* includes an N-channel metal oxide semiconductor as an N-channel MOS transistor. One terminal of the DC-DC converter 2 is connected to the battery B, and the other terminal of the DC-DC converter 2 is connected to the ground. In FIG. 2, a diode 2*d* is a parasitic diode formed with the N-channel transistor. The anode of the diode 2*d* is connected to the ground, and the cathode of the diode 2*d* is connected to a coil 2*c*. In the DC-DC converter 2, the charge switch 2*s* is subjected to an on-off operation, thereby voltage such as 12V of the battery B is stepped up to high voltage such as 200V to 300 V for controlling the electric charge of the piezo elements Pa and Pb.

The voltage stepped up by the DC-DC converter 2 is applied to a capacitor 6 via a diode 4. One terminal of the capacitor 6 is connected to the cathode of the diode 4, and the other terminal of the capacitor 6 is grounded. When the voltage stepped up by the DC-DC converter 2 is applied to the capacitor 6, the capacitor 6 accumulates electric charge to be supplied to the piezo elements Pa and Pb. The capacitor 6 desirably has a capacitance, such as several hundred microfarads, at which the voltage of the capacitor is substantially stable even when the capacitor supplies electricity required for one-time charging of the piezo elements Pa and Pb.

The terminal with high potential of the capacitor 6 and the cathode of the diode 4 are connected with terminals with high potential of the piezo elements Pa and Pb via a series-connected body of a charge switch 10 and a charge and discharge coil 12. The terminals with low potential of the piezo elements Pa and Pb are respectively grounded via a series-connected body, which includes a selection switch 14*a* and a resistance 16*a*, and a series-connected body, which includes a selection switch 14*b* and a resistance 16*b*.

Here, the charge switch 10 configures a switching unit including an N-channel MOS transistor. In FIG. 2, a diode 10*d* is a parasitic diode formed with the transistor. The anode of the diode 10*d* is connected to the charge and discharge coil 12, and the cathode of the diode 10*d* is connected to the diode 4. The selection switches 14*a* and 14*b* respectively include N-channel MOS transistors. In FIG. 2, diodes da and db are parasitic diodes, which are respectively formed with the transistors. The anodes of the diodes da and db are connected to the ground, and the cathodes of the diodes da and db are respectively connected to the piezo elements Pa and Pb.

One terminal of a discharge switch 18 is connected with the connection between charge switch 10 and the charge and discharge coil 12, and the other terminal of the discharge switch 18 is grounded. Here, the discharge switch 18 configures a switching unit including an N-channel MOS transistor. In FIG. 2, a diode 18*d* is formed with the transistor. The anode of the diode 18*d* is connected to the ground, and the cathode of the diode 18*d* is connected to the connection between the charge switch 10 and the charge and discharge coil 12.

The controller 20 is a hardware for operating the charge switch 10 and the discharge switch 18 according to an instruction from the electronic control unit 30. In the present embodiment, the controller 20 outputs a signal to the charge switch 10 and the discharge switch 18 via a driver circuit (not shown) in order to drive the charge switch 10 and the discharge switch 18 at high speed. The driver circuit is desirably supplied with an electric current from the terminal with high potential of the capacitor 6.

Next, the charge control and the discharge control of the piezo elements Pa and Pb are described. The charge control and the discharge control are performed by the electronic control unit 30 and the controller 20.

Figure 3:
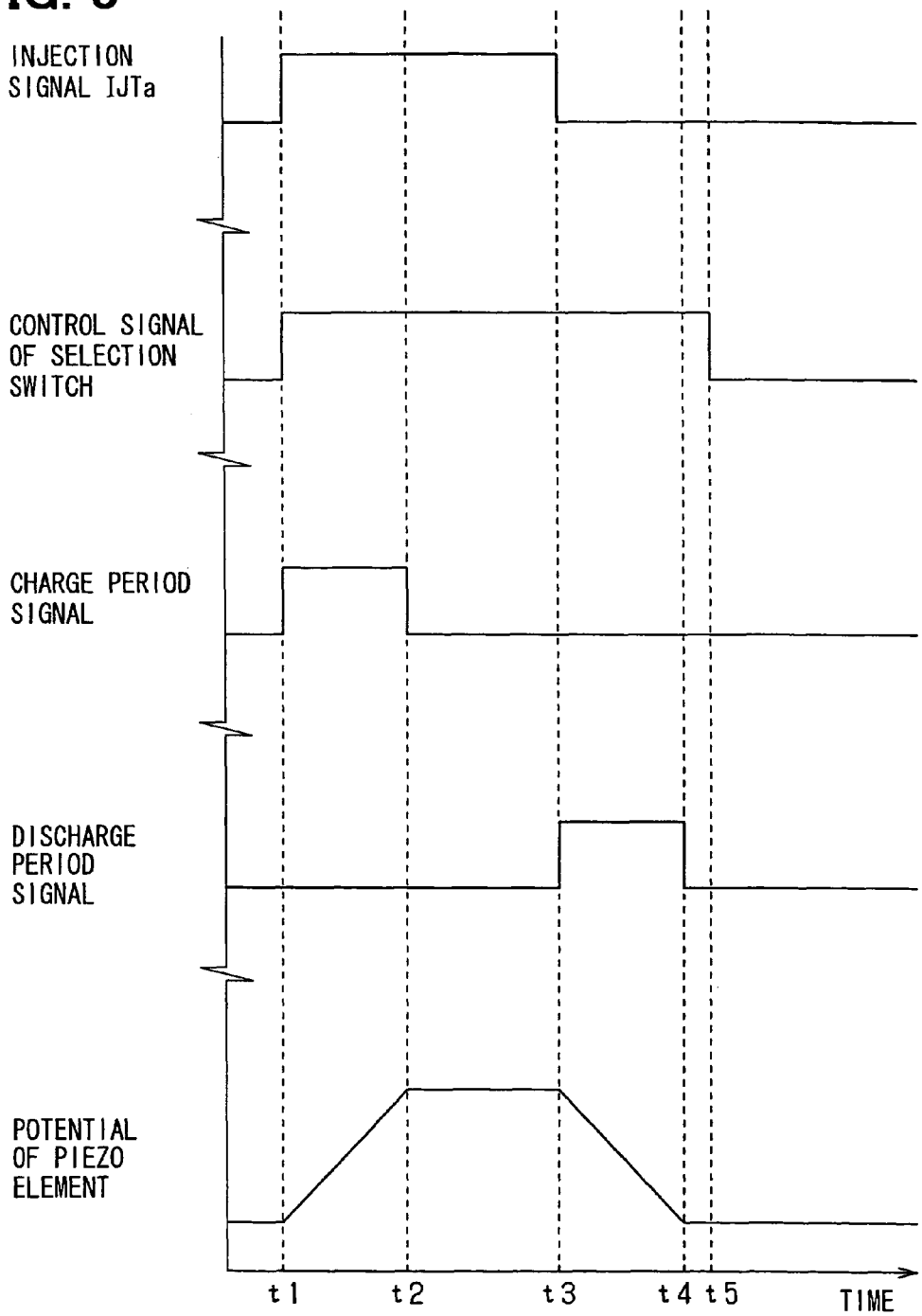
FIG. 3 is a time chart showing a charge and discharge control in the embodiment.

FIG. 3 shows a time chart showing a state of each of the charge control and the discharge control. The top chart in FIG. 3 shows a transition of an injection signal for directing an injection timing and an injection period of fuel by setting the logical value of the signal at "H". In FIG. 3, an injection signal IJTa, which corresponds to the piezo element Pa, is exemplified. The second chart from the top in FIG. 3 shows a transition of a control signal that selectively turns on either of the selection switches 14*a* and 14*b* by setting the logical value of the signal at "H". In FIG. 3, a control signal for the selection switch 14*a* is exemplified. The third chart from the top in FIG. 3 shows a transition of a charge period signal for directing a timing and a period in which the piezo elements Pa and Pb are charged through an operation of the charge switch 10 by setting a logical value of the signal at "H". The fourth chart from the top in FIG. 3 shows a transition of a discharge period signal for directing a timing and a period in which the piezo elements Pa and Pb are discharged through an operation of the discharge switch 18 by setting a logical value of the signal at "H". The bottom chart in FIG. 3 shows a transition of potential at the terminals with high potential of the piezo elements Pa and Pb.

In the series of the controls, when the injection signal IJTa is inputted from the electronic control unit 30 into the controller 20 at time t1, the controller 20 performs the following processings. First, according to the injection signal IJTa, the controller 20 generates the charge period signal in a mode that the signal is in the logic value "H" from time t1 to time t2, and outputs a selection control signal such that the selection switch 14*a* is selectively turned on. In addition, the controller 20 controls the charge switch 10 to be subjected to an on-off operation according to the generated charge period signal. The charge period signal may be generated by the electronic control unit 30.

Figure 4A:
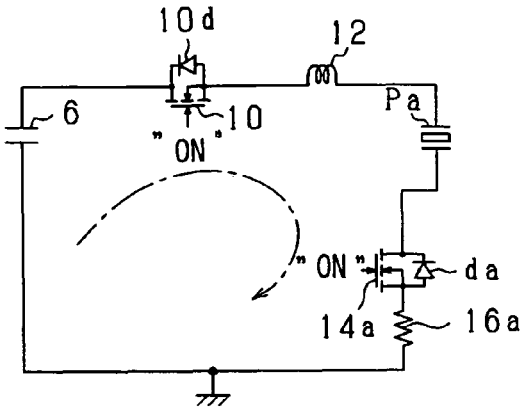
FIGS. 4A, 4B are diagrams showing flow aspects of a current in a charge control.
Figure 4B:
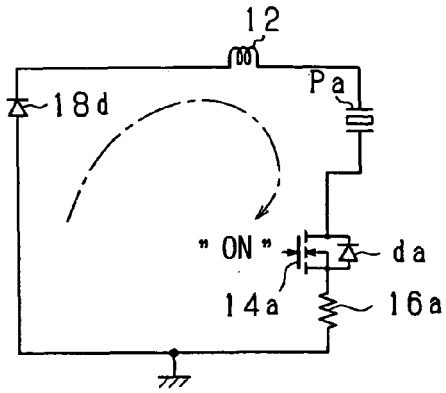

Here, as shown in FIG. 4A, when the charge switch 10 as a switching unit is turned on, a closed loop circuit is formed. The closes loop circuit includes the capacitor 6, the charge switch 10, the charge and discharge coil 12, the piezo element Pa, the selection switch 14*a*, and the resistance 16*a*. Thus, electricity of the capacitor 6 is charged to the piezo element Pa. As shown in FIG. 4B, after the on operation of the charge switch 10, the charge switch 10 is turned off, and thereby a closed loop circuit is formed. The closed loop circuit includes the diode 18*d*, the charge and discharge coil 12, the piezo element Pa, the selection switch 14*a*, and the resistance 16*a*. Thus, flywheel energy of the charge and discharge coil 12 is exerted to the piezo element Pa.

The charge switch 10 is operated in the above mode, so that the piezo element Pa is charged, and the potential at the terminal with high potential of the piezo element Pa increases. The closed loop circuit as shown in FIG. 4A is a current path along which power of the capacitor 6 is supplied via the charge and discharge coil 12, and the charge switch 10 functions to control opening and closing of the current path.

On the other hand, when the injection signal IJTa is set at the logic value "L" at the time t3 shown in FIG. 3, the controller 20 generates the charge period signal in a mode that the charge period signal is in the logic value "H" from the time t3 to the time t4. Whereby, the controller 20 controls the discharge switch 18 to be subjected to the on-off operation.

Figure 4C:
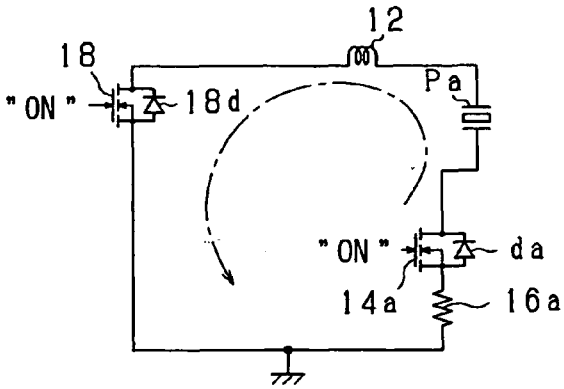
FIGS. 4C, 4D are diagrams showing flow aspects of a current in a discharge control in the embodiment.
Figure 4D:
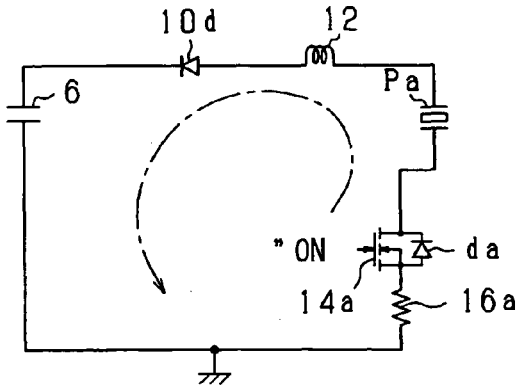

That is, as shown in FIG. 4C, when the discharge switch 18 is turned on, a closed loop circuit is formed. The closed loop circuit includes the discharge switch 18, the charge and discharge coil 12, the piezo element Pa, the selection switch 14*a*, and the resistance 16*a*. Thus, the piezo element Pa is discharged. Furthermore, after the on operation of the discharge switch 18 is performed, the discharge switch 18 is turned off. In the present condition, as shown in FIG. 4D, a closed loop circuit is formed by the capacitor 6, the diode 10*d*, the charge and discharge coil 12, the piezo element Pa, the selection switch 14*a*, and the resistance 16*a*. Thus, flywheel energy of the charge and discharge coil 12 is collected by the capacitor 6 via the diode 10*d*.

The discharge switch 18 is operated in the above mode, and thereby the piezo element Pa is discharged, and the potential decreases at the terminal with high potential of the piezo element Pa. After the control period for discharge, the selection switch 14*a* is turned off at the time t5. The on-off operation of the charge switch 10 and the on-off operation of the discharge switch 18 are performed in the modes as described above, whereby the charge and discharge control of the piezo elements Pa and Pb can be performed.

Figure 5:
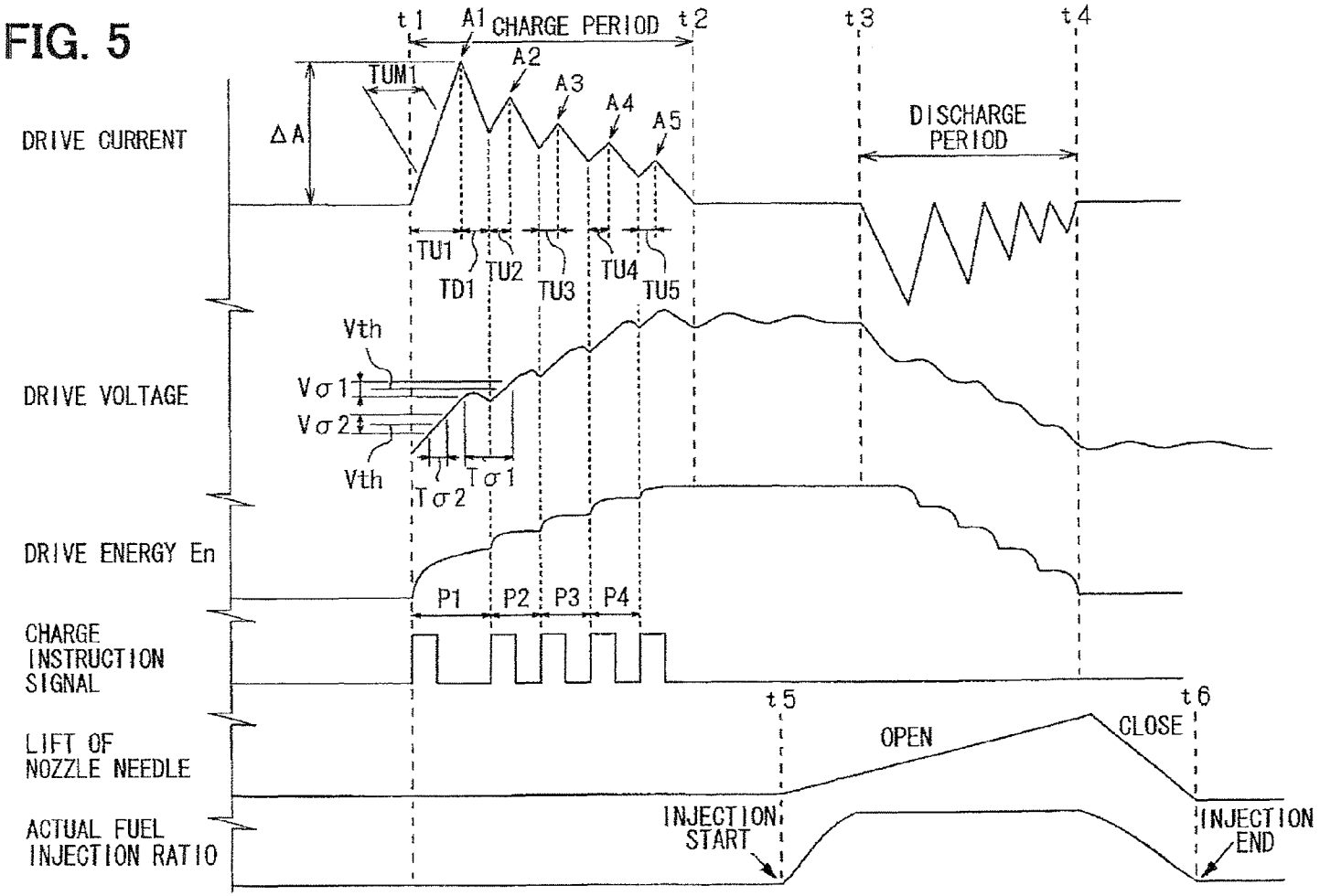
FIG. 5 is a time chart showing a charge control aspect and a discharge control aspect according to the embodiment.

Here, the charge control and the discharge control are described further in detail according to FIG. 5. FIG. 5 shows an exemplified injection mode in the case that fuel is injected one time per combustion cycle. Alternatively, the present control may be similarly applied to an injection mode where fuel is injected for several times per combustion cycle.

The top chart in FIG. 5 shows a transition of the drive current to be supplied to the piezo elements Pa and Pb. The second chart from the top in FIG. 5 shows a transition of drive voltage at the terminal with high potential of the piezo elements Pa and Pb. The third chart from the top in FIG. 5 shows a transition of electric drive energy accumulated in the piezo elements Pa and Pb. The fourth chart from the top in FIG. 5 shows a transition of an on-off operation state of the charge instruction signal to turn on the charge switch 10 shown in the FIG. 2. The fifth chart from the top in FIG. 5 shows the lift of the nozzle needle 54. The sixth chart from the top in FIG. 5 shows change in actual fuel injection amount per unit time. The change in actual fuel injection amount per unit time corresponds to an actual fuel injection ratio.

In the series of processings as shown in FIG. 5, when the injection signals (IJTa and IJTb) are first outputted from the electronic control unit 30 at the time t1, the operation of the selection switches 14*a* and 14*b* and the generation of the charge period signal are performed in the mode as shown in the third chart in FIG. 3. In addition, the controller 20 performs the following processings according to the charge period signal. Specifically, the charge switch 10 is subjected to the on-off operation in the charge period t1 to t2 being specified by the charge instruction signal in the fourth chart in FIG. 5, and thereby the piezo elements Pa and Pb are charged.

In the charge period t1 to t2, the drive current starts to increase at the timing t1, at which the charge switch 10 is turned on in accordance with the on-signal of the charge instruction signal as a trigger. Thereafter, the drive current starts to decrease at the time point when a predetermined amount of the electric charge is accumulated in each of the piezo elements Pa and Pb. That is, as shown in the top chart in FIG. 5, during the charge period given by the turning on of the charge switch 10, the drive current increases in the current increasing period TU1. Then, as shown in FIG. 4B, during the period of the charge by the flywheel energy after the charge switch 10 is turned off, the drive current decreases in the current decrease period TD1.

Then, the drive current starts to increase again at the timing, at which the charge switch 10 is turned on according to the charge instruction signal, and the drive current starts to decrease at the point when a predetermined amount of charge are accumulated in each of the piezo elements Pa and Pb. While such increase and decrease of the drive current are repeated for several times as shown in the top chart in FIG. 5, the drive voltage and the electric drive energy are increased as shown in the second and third charts in FIG. 5, so that the piezo elements are charged.

In the discharge period t3 to t4, the drive current starts to decrease at the time point when the discharge switch 18 is turned on, and the drive current starts to increase at the time point when a predetermined amount of charge is discharged from each of the piezo elements Pa and Pb. While such increase and decrease of the drive current are repeated for several times as shown in the top chart in FIG. 5A, the drive voltage and the electric drive energy are decreased as shown in the second and third charts in FIG. 5, so that the accumulated electricity is discharged from the piezo elements Pa and Pb.

After the charging of the piezo elements Pa and Pb is started, at the time point when the drive voltage value exceeds a threshold value Vth as shown in the second chart in FIG. 5, the three-way valve 66 starts to be lifted from the low-pressure valve seat 74 so as to start to open. Then, the three-way valve 66 is lifted from both the low-pressure valve seat 74 and the high-pressure valve seat 75, and thereafter the three-way valve is seated on the high-pressure valve seat 75.

As shown in the fifth chart in FIG. 5, the nozzle needle 54 starts to open at the time point t5, and the lift of the nozzle needle 54 increases. As shown in the bottom chart in FIG. 5, the actual fuel injection ratio starts to increase along with the increase in lift, and the injection port 57 starts fuel injection. On the other hand, when the piezo elements are discharged in the discharge period t3 to t4, the nozzle needle 54 starts closing. Whereby, the lift of the nozzle needle 54 decreases. The actual fuel injection ratio starts to decrease along with the decrease in lift. Thus, the three-way valve 66 is seated on the low-pressure valve seat 74, and the fuel injection ends at the time point t6.

Here, since the threshold value Vth is changed depending on aged deterioration or a temperature characteristic of each of the piezo elements Pa and Pb, or individual difference between the piezo injectors PIa and PIb, variation may occur in timing at which the three-way valve 66 starts to open. Moreover, the variation may be even caused by individual difference between the piezo injectors PIa and PIb. Accordingly, variation may occur in the opening timing as the injection start timing at which the nozzle needle 54 is lifted from the needle seat 56.

The inventor made more detailed investigation on a cause of a variation in injection start timing.

Specifically, the threshold value Vth corresponds to the voltage value at which the backpressure control valve starts operation. When a variation range Val of the threshold value Vth extends over multiple voltage increasing periods as exemplified by a symbol Vσ1 in the second chart in FIG. 5, the variation in operation start timing of the backpressure control valve is in the range shown by a symbol Tσ1. On the other hand, when a variation range Vσ2 of the threshold value Vth is within a predetermined voltage increasing period as exemplified by a symbol Vσ2 in the second chart in FIG. 5, the variation in operation start timing of the backpressure control valve is in the range shown by a symbol Tσ2.

In other words, when an increasing period, in which the drive voltage of the piezo elements exceeds the threshold value Vth, is not fixed to one of the multiple current increasing periods TU1 and TU2 (FIG. 5), the drive voltage may change over the multiple current increasing periods TU1, TU2, and the like when exceeding the threshold value Vth. In a case where the drive voltage changes over the current increasing periods TU1 and TU2 when exceeding the threshold value Vth, the variation range of the operation start timing of the backpressure control valve is Tσ1. When the drive voltage exceeds the threshold value Vth in a predetermined current increasing period, the variation range of operation start timing of the backpressure control valve is small. Specifically, for example, when the drive voltage exceeds the threshold value Vth in the period TU1, the variation range of operation start timing of the backpressure control valve is Tσ2.

The variation range Tσ2 does not include a current decreasing period TD1. On the contrary, the variation range Tσ1 includes the current decreasing period TD1. Therefore, Tσ1>Tσ2 is given. That is, the inventor found the following cause: when the current increasing period, in which the drive voltage reaches the threshold value Vth, is not fixed to one of current increasing periods TU1, TU2, and the like, the variation range of the operation start timing of the backpressure control valve is increased. Consequently, variation in injection start timing is increased.

Therefore, in the present embodiment, the charge instruction signal as a trigger signal for turning on the charge switch 10 is generated such that the drive voltage value exceeds the threshold value Vth in an intermediate period TUM1 being in the middle of the increasing period TU1 (specific increasing period). The increasing period TU1 first appears among multiple increasing periods TU1, TU2, TU3, TU4, and TU5 in which the drive current increases. Specifically, the signal is generated such that the waveform of the charge instruction signal has an irregular pitch. That is, when the pitch between the on-timing of the charge switch 10 being a start trigger of the increasing period TU1 and the on-timing of the charge switch 10 being a start trigger of the next increasing period TU2 is assumed to be P1. Subsequent pitches are assumed to be P2, P3 and P4, while the P2, P3 and P4 are equal to one another, P1 is set to be longer than each of P2, P3 and P4.

The present operation may reduce a possibility that a variation range of the threshold value Vth extends over multiple voltage increasing periods as shown by the symbol Vσ1, so as to restrict the variation range from including the current decreasing period TD1, dissimilarly to the symbol Vσ2, which includes the current decreasing period TD1. Accordingly, a variation range of the operation start timing of the three-way valve 66 can be reduced, and consequently a variation range of injection start timing can be reduced.

The intermediate period TUM1 is preferably set as a period of a middle portion except for both end periods of the current increasing period TU1. For example, the intermediate period TUM1 is preferably set except for a period corresponding to 10% of TU1.

Alternatively, a period corresponding to a predetermined current increasing amount in a current increasing period from the increasing start point t1, at which the drive current value is 0 A, to a peak current value such as 25 A may be preferably set as the intermediate period TUM1. For example, the amount corresponding to 10% of the total increasing amount ΔA (refer to FIG. 5A) in the current increasing period TU1 may be preferably set as the intermediate period TUM1.

Referring to the top and fourth charts in FIG. 5, the on-off signal waveform of the charge instruction signal is formed such that the peak value A1 of the drive current first appears in the increasing period TU1 as a specific increasing period, and the peak value A1 is larger than the peak value of any of other increasing periods TU2, TU3, TU4, and TU5. In addition, the on-off signal waveform of the charge instruction signal is formed such that the increasing amount ΔA of the drive current in the specific increasing period TU1 is larger than increasing amount of the drive current in any of other increasing periods TU2, TU3, TU4, and TU5. According to the present structure, the specific increasing period TU1 is lengthened, thereby the possibility that the variation range of the threshold value Vth extends over multiple voltage increasing periods as exemplified by the symbol Vσ1 can be may further reduced. Thus, certainty that the voltage value exceeds the threshold value in the specific increasing period TU1 can be improved.

Second Embodiment

The present embodiment is in common with the first embodiment in that an on-off signal waveform of a charge instruction signal is formed such that the drive voltage value exceeds the threshold value Vth in the intermediate period TUM1 of the specific increasing period. Furthermore, in the present embodiment, the specific increasing period is modified depending on an operation condition of a diesel engine.

Figure 6A:
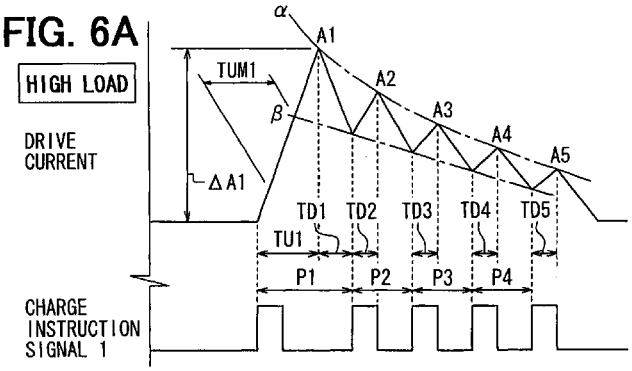

Specifically, as shown in FIG. 6A, during a high load operation of the engine, the specific increasing period is set to be the first increasing period TU1. In addition, an on-off signal waveform as the charge instruction signal waveform 1 is formed such that the drive voltage value exceeds the threshold value Vth in the intermediate period TUM1 of the increasing period TU1. That is, a pitch P1 is set to be longer than each of subsequent pitches P2, P3 and P4. The pitch P1 extends from the on-timing of the charge switch 10 according to the on-signal of the charge instruction signal being the start trigger of the increasing period TU1 to the on-timing of the charge switch 10 according to the on-signal of the charge instruction signal being the start trigger of the next increasing period TU2.

Figure 6B:
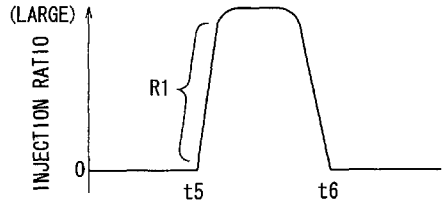
Figure 6C:
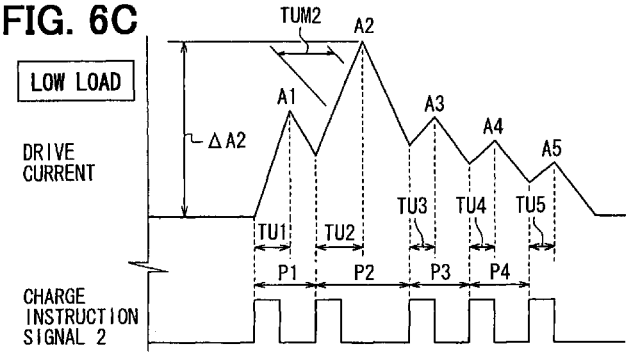

On the other hand, as shown in FIG. 6C, during a low load operation of the engine, the specific increasing period is set to be the increasing period TU2, which appears second, and the on-off signal waveform is formed such that the drive voltage value exceeds the threshold value Vth in an intermediate period TUM2 of the increasing period TU2. That is, the pitch P2 is set to be longer than each of other pitches P1, P3 and P4.

Referring to FIG. 6A, during the high load operation of the engine, the on-off signal waveform of the charge instruction signal is formed such that the peak value A1 of the drive current in the specific increasing period TU1 is larger than the peak value of the drive current in any of other increasing periods TU2, TU3, TU4, and TU5. In addition, the on-off signal waveform of the charge instruction signal is formed such that the increasing amount ΔA1 of the drive current in the specific increasing period TU1 is larger than the increasing amount of the drive current in any of other increasing periods TU2, TU3, TU4, and TU5. Accordingly, the specific increasing period TU1 is lengthened, and hence certainty that the voltage value exceeds the threshold value in the specific increasing period TU1 can be improved as in the first embodiment.

Referring to FIG. 6C, during the low load operation of the engine, the on-off signal waveform of the charge instruction signal is formed such that the peak value A2 of the drive current in the specific increasing period TU2 is larger than the peak value of the drive current in any of other increasing periods TU1, TU3, TU4, and TU5. In addition, the on-off signal waveform of the charge instruction signal is formed such that the increasing amount ΔA2 of the drive current in the specific increasing period TU2 is larger than increasing amount of the drive current in any of other increasing periods TU1, TU3, TU4, and TU5. Accordingly, the specific increasing period TU2 is lengthened, and hence certainty that the voltage value exceeds the threshold value in the specific increasing period TU2 can be improved as in the first embodiment.

Figure 7:
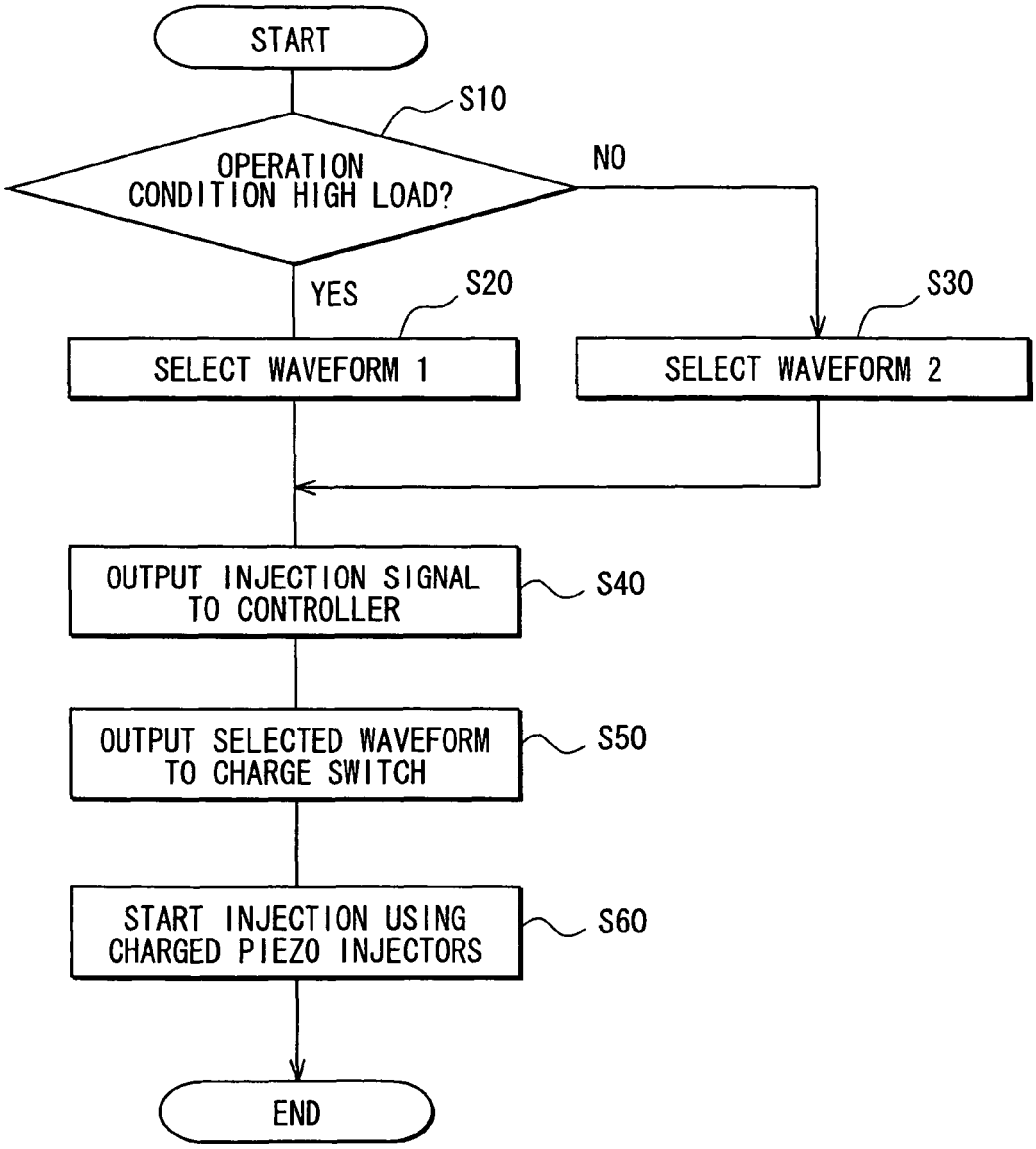
FIG. 7 is a flow chart showing an operation of an electronic control unit, a controller, and piezo injectors in the second embodiment.

The procedure shown in FIG. 7 is executed by the electronic control unit 30 and the controller 20 for manipulating the piezo injectors PIa and PIb. First, the electronic control unit 30 determines whether an operation condition of the engine is in the high load condition at S10. For example, the electronic control unit 30 may determine that the engine is in the higher load condition when at least one of engine rotation speed, the throttle position, and intake pressure is high. When the electronic control unit 30 determines that the engine is in the high load condition, the electronic control unit 30 selects the waveform 1 shown in FIG. 6A as the on-off waveform of the charge instruction signal at S20. When the electronic control unit 30 determines that the engine is not in the high load condition, the electronic control unit 30 selects the waveform 2 shown in FIG. 6C at S30.

Next, the electronic control unit 30 outputs the injection signals IJTa and IJTb, which respectively instruct the selected waveform of the charge instruction signal, to the controller 20 at S40. The controller 20 inputs the injection signals IJTa and IJTb, thereby to output the selected waveform of the charge instruction signal at S50. Thus, the drive current repeatedly increased and decreased as shown in FIG. 6A or 6C, and thereby the piezo elements Pa and Pb are charged, and the piezo injectors PIa and PIb start the fuel injection operation at S60.

Figure 6D:
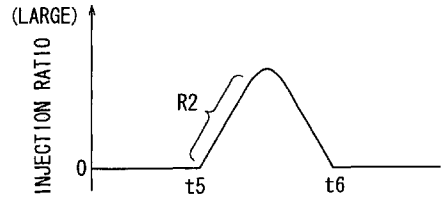

According to the present embodiment described in detail hereinbefore, the following advantage is produced in addition to the advantage as in the first embodiment. That is, the on-off signal waveform is formed such that the specific increasing period, in which the drive voltage value exceeds the threshold value Vth, is set to be the first increasing period TU1 in the high load operation of the engine, and the specific increasing period is set to be the increasing period TU2 that appears second in the low load operation of the engine. In the case of high load operation as shown in FIGS. 6B and 6D, a fuel injection ratio is abruptly increased by defining the slope of R1 to be steeper than the slope of R2, and hence the output of the engine can be increased. On the other hand, in the case of low load operation, the fuel injection ratio is gradually increased by defining the slope of R2 to be gentler than a slope of R1, and hence heat generation can be reduced in the driver unit 1, while the output of the engine is also gradually increased. Thus, circuit efficiency can be improved.

In the present second embodiment, the specific increasing period is set earlier in the high-load operation of the engine than the increasing period in the low-load operation condition.

In the present operation, the fuel injection ratio can be quickly increased in the high-load operation, whereby the output power of the engine can be enhanced. On the other hand, the fuel injection ratio is gradually increased in the low-load operation. Therefore, the specific increasing period can be set at a late time point in the low-load operation. Thus, the efficiency of the charging circuit and the switching unit can be enhanced by the following reason.

Specifically, the voltage of the piezo elements is low at the initial charging of the piezo elements, and hence the voltage difference between the electric power supply such as the DC-DC converter 2 shown in FIG. 2 and the piezo elements is large. In the present case, electric consumption is large at the same electric current since P=VI, therefore thermal generation in the circuit becomes large. That is, the circuit causes large energy loss, and efficiency of the circuit becomes low. Therefore, according to the present second embodiment, the specific increasing period can be set later, and hence the efficiency of the circuit can be enhanced.

Other Embodiments

The invention is not limited to the described contents of the embodiments, and characteristic structures of the respective embodiments may be optionally combined with one another. Moreover, for example, the invention may be carried out in the following way.

(1) In the first embodiment, the on-off waveform of the charge instruction signal, that is, the on-off signal waveform of the charge switch 10 is fixed. When the on-off signal waveform is fixed in this way, in the case that the threshold value Vth is changed due to aged deterioration of the piezo element Pa or Pb, a variation range of the threshold value Vth may extend over multiple voltage increasing periods.

On the other hand, as another embodiment, the on-off waveform of the charge instruction signal may be variable, and thereby the length of the pitch P1 is adjusted during the operation of the diesel engine such that the drive voltage value exceeds the threshold value Vth in the intermediate period, so that the length of the increasing period TU1 is adjusted. According to the present structure, since the on-off signal waveform set as above is adjusted depending on change in threshold value Vth, the variation range of the threshold value Vth can be restricted from extending over the multiple voltage increasing periods.

When the on-off signal waveform is made variable during the engine operation, the increasing period, in which the actual threshold value Vth appears, is required to be estimated among the multiple increasing periods TU1 to TU5. For example, in such an estimation, the injection timing, at which fuel is actually injected from each of the piezo injectors PIa and PIb, may be detected, and the operation start timing of the three-way valve 66 may be estimated from the injection timing. Whereby, the increasing period, in which the threshold value Vth appears, may be estimated among the multiple increasing periods TU1 to TU5. The injection timing may be estimated from at least one of a detection value of an A/F sensor, a combustion timing (ignition timing) value, and an engine rotation speed value, for example.

(2) In the first embodiment, when the on-off waveform of the charge instruction signal is fixed, the specific increasing period is set to be the increasing period TU1 that appears first. Alternatively, the specific increasing period may be set to be the increasing period TU2 that appears second.

(3) In the embodiments, the on operation of the charge instruction signal for the on operation of the charge switch 10 is used as a start trigger of increasing the drive current, and the subsequent accumulation of a predetermined amount of charge in the piezo elements Pa and Pb is used as a start trigger of decreasing the drive current. On the other hand, the off operation of the charge instruction signal may be used as the start trigger of decreasing the drive current. Alternatively, as shown by the dashed lines in FIG. 6A, arrival of the drive current to a predetermined upper-limit value $\alpha$ may be used as the start trigger of decreasing the drive current. Alternatively, arrival of the drive current to a predetermined lower-limit value $\beta$ may be used as the start trigger of increasing the drive current.

(4) In the embodiments, the on-off waveform of the charge instruction signal, that is, the on-off signal waveform of the charge switch 10 is formed such that the peak value A2 (FIG. 6C) of the drive current in the specific increasing period TU2 is larger than the peak value of the drive current in any of other increasing periods TU1, TU3, TU4, and TU5. On the other hand, the peak value A2 of the drive current in the increasing period TU2 may be equal to the peak value A1 in the first increasing period TU1 or may be smaller than the peak value A1.

(5) In the piezo injectors PIa and PIb according to the embodiments, the three-way valve 66 is actuated by the piezo elements Pa and Pb, and the nozzle needle 54 is actuated by such actuation of the three-way valve 66. The above structures are not limitedly applied to such a piezo injectors PIa and PIb. For example, the above structures may be applied to a direct-acting piezo injector in which the three-way valve 66 is removed, and the nozzle needle 54 is directly activated by the piezo elements Pa and Pb.

(6) In the embodiments, while the period except for both end periods of the current increasing period TU1, the end periods being corresponding to 10% of the period TU1, is set to be the intermediate period TUM1, the end periods are not limited to 10% of the current increasing period TU1, and may be 20%, 5% or 3% of the period TU1.

Here, it is conceived that the switching timing of the switching unit may be fixed as one example. However, when the threshold value Vth varies due to aged deterioration of the piezo elements in the case where the switching timing is fixed, the threshold value Vth may extend over multiple voltage increasing periods.

Therefore, an adjustment unit may be provided to adjust the switching timing such that the voltage exceeds the threshold value in the intermediate period during the operation of the engine provided with the fuel injection valve.

By providing the adjustment unit, as described above, even when the threshold value Vth varies due to age deterioration or the like, the set switching timing can be adjusted in accordance with the aged deterioration or the like. Therefore, the threshold value Vth can be restricted within the specific voltage increasing period.

The above structures and operations can be applied to a charge control method. The charge control method for a fuel injection valve may include setting of the switching timing of the switching unit such that the voltage exceeds the threshold value at an intermediate period, which is in the middle of the specific increasing period of multiple increasing periods in each of which the driving current increases.

The above structures of the embodiments can be combined as appropriate. The above processings such as calculations and determinations are not limited being executed by the controller 20 and the electronic control unit 30. The control unit may have various structures including the controller 20 and the electronic control unit 30 shown as an example.

The above operations including processings such as calculations and determinations may be performed by any one or any combinations of software, an electric circuit, and the like. The electric circuit may be an integrated circuit, and may be a discrete circuit such as a hardware logic configured with electric or electronic elements or the like. The elements producing the above processings may be discrete elements and may be partially or entirely integrated. For example, at least part of the signals in the circuit structures in the above embodiments may be converted to digital signals, and substantially the same processings such as the comparison, the amplification, and other operations may be performed using the converted digital signals by employing a microcomputer, a programmable logic circuit, and the like.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A charge control unit for controlling electricity charged to a piezo element, which is for actuating a backpressure control valve so as to control backpressure applied to a valve element for a fuel injection valve, wherein the backpressure control valve is configured to start to decrease the backpressure to actuate the valve element to open an injection port of the fuel injection valve when voltage of the electricity exceeds a threshold, the charge control unit comprising:

a charge unit configured to increase the voltage by repeating increasing and decreasing a drive current, which is supplied to the piezo element, for a plurality of times for charging the piezo element; and a switching unit configured to alternate the increasing and the decreasing in the drive current such that the voltage exceeds the threshold in an intermediate period in a middle of a specific increasing period among a plurality of increasing periods, in each of which the drive current increases, wherein the specific increasing period is selected from the plurality of increasing periods depending on an operation of an internal combustion engine, and the specific increasing period is set to appear at an early timing in a case where the internal combustion engine is in a high-load operation compared with a late timing in a case of a low-load operation, wherein the charge unit includes:

a determination unit configured to determine whether the internal combustion engine is in the high-load operation or the low-load operation; and a control unit configured to:

i) select the specific increasing period from the plurality of increasing periods to cause the selected specific increasing period to appear at the early timing in response to determination of the determination unit that the internal combustion engine is in the high-load operation; and ii) select the specific increasing period from the plurality of increasing periods to cause the selected specific increasing period to appear at the late timing in response to determination of the determination unit that the internal combustion engine is in the low-load operation, wherein the early timing is earlier than the late timing.

2. The charge control unit according to claim 1, wherein the specific increasing period is set to first appear among the plurality of increasing periods in the high-load operation.

3. The charge control unit according to claim 1, wherein the specific increasing period is set to second appear among the plurality of increasing periods in the low-load operation.

4. The charge control unit according to claim 1, wherein the switching unit is configured to perform the alternation such that increasing in the drive current in the specific increasing period is largest among the plurality of increasing periods.

5. The charge control unit according to claim 1, wherein the switching unit is configured to perform the alternation such that a peak value of the drive current in the specific increasing period is largest among the plurality of increasing periods.

6. The charge control unit according to claim 1, further comprising:

an adjustment unit for adjusting the timing of the alternation such that the voltage exceeds the threshold in the intermediate period in an operation of an internal combustion engine having the fuel injection valve.

7. A fuel-injection-valve charge control system, comprising:

the charge control unit according to claim 1, and a fuel injection valve having the piezo element as an actuator.

8. The charge control unit according to claim 1, wherein the specific increasing period is selected from second or latter increasing period of the plurality of increasing periods.

9. The charge control unit according to claim 8, wherein the charge unit is configured to repeat increasing and decreasing the drive current for the plurality of times to repeat increasing and decreasing the voltage for a plurality of times thereby to increase the voltage through the repeat of increasing and decreasing the voltage.

10. The charge control unit according to claim 9, wherein the switching unit is configured to alternate the increasing and the decreasing in the drive current such that the voltage exceeds the threshold in an intermediate period in a middle of a specific increasing period among a plurality of increasing periods, in each of which the voltage increases.

11. A charge control unit for controlling electricity charged to a piezo element, which is for actuating a backpressure control valve so as to control backpressure applied to a valve element for a fuel injection valve, wherein the backpressure control valve is configured to start to decrease the backpressure to actuate the valve element to open an injection port of the fuel injection valve when voltage of the electricity exceeds a threshold, the charge control unit comprising:

a charge unit configured to repeat increasing and decreasing a drive current, which is supplied to the piezo element, for a plurality of times to repeat increasing and decreasing the voltage for a plurality of times to increase the voltage through the repeat of increasing and decreasing the voltage thereby charging the piezo element; and a switching unit configured to alternate the increasing and the decreasing in the drive current such that the voltage exceeds the threshold in an intermediate period in a middle of a specific increasing period among a plurality of increasing periods, in each of which the drive current increases, wherein the specific increasing period is selected from the plurality of increasing periods depending on an operation of an internal combustion engine, and the specific increasing period is set to appear at an early timing in a case where the internal combustion engine is in a high-load operation compared with a late timing in a case of a low-load operation, wherein the charge unit includes:

a determination unit configured to determine whether the internal combustion engine is in the high-load operation or the low-load operation; and a control unit configured to:

i) select the specific increasing period from the plurality of increasing periods to cause the selected specific increasing period to appear at the early timing in response to determination of the determination unit that the internal combustion engine is in the high-load operation; and ii) select the specific increasing period from the plurality of increasing periods to cause the selected specific increasing period to appear at the late timing in response to determination of the determination unit that the internal combustion engine is in the low-load operation, wherein the early timing is earlier than the late timing.

12. The charge control unit according to claim 11, wherein the specific increasing period is selected from second or latter increasing period of the plurality of increasing periods.

13. The charge control unit according to claim 12, wherein the switching unit is configured to alternate the increasing and the decreasing in the drive current such that the voltage exceeds the threshold in an intermediate period in a middle of a specific increasing period among a plurality of increasing periods, in each of which the voltage increases.

14. A charge control unit for controlling electricity charged to a piezo element, which is for actuating a backpressure control valve so as to control backpressure applied to a valve element for a fuel injection valve, wherein the backpressure control valve is configured to start to decrease the backpressure to actuate the valve element to open an injection port of the fuel injection valve when voltage of the electricity exceeds a threshold, the charge control unit comprising:

a charge unit configured to increase the voltage by repeating increasing and decreasing a drive current, which is supplied to the piezo element, for a plurality of times for charging the piezo element; and a switching unit configured to alternate the increasing and the decreasing in the drive current such that the voltage exceeds the threshold in an intermediate period in a middle of a specific increasing period among a plurality of increasing periods, in each of which the drive current increases, wherein the charge unit includes:

a determination unit configured to determine whether an internal combustion engine is in a high-load operation or a low-load operation; and a control unit configured to:

i) select the specific increasing period from the plurality of increasing periods to cause the selected specific increasing period to appear at a first timing in response to determination of the determination unit that the internal combustion engine is in the high-load operation; and ii) select the specific increasing period from the plurality of increasing periods to cause the selected specific increasing period to appear at the second timing in response to determination of the determination unit that the internal combustion engine is in the low-load operation, wherein the first timing is earlier than the second timing.

15. A charge control unit for controlling electricity charged to a piezo element, which is for actuating a backpressure control valve so as to control backpressure applied to a valve element for a fuel injection valve, wherein the backpressure control valve is configured to start to decrease the backpressure to actuate the valve element to open an injection port of the fuel injection valve when voltage of the electricity exceeds a threshold, the charge control unit comprising:

a charge unit configured to increase the voltage by repeating increasing and decreasing a drive current, which is supplied to the piezo element, for a plurality of times for charging the piezo element; and a switching unit configured to alternate the increasing and the decreasing in the drive current such that the voltage exceeds the threshold in an intermediate period in a middle of a specific increasing period among a plurality of increasing periods, in each of which the drive current increases, wherein the charge unit includes:

a determination unit configured to determine whether an internal combustion engine is in a high-load operation or a low-load operation; and a control unit configured to:

i) select the specific increasing period from the plurality of increasing periods to cause the selected specific increasing period to appear at a first timing in response to determination of the determination unit that the internal combustion engine is in the high-load operation; and ii) select the specific increasing period from the plurality of increasing periods to cause the selected specific increasing period to appear at another timing, which is later than the first timing, in response to determination of the determination unit that the internal combustion engine is in the low-load operation.

* * * * *